US009305493B2

(12) United States Patent
Zhang et al.

(10) Patent No.: US 9,305,493 B2
(45) Date of Patent: Apr. 5, 2016

(54) ORGANIC LIGHT EMITTING DIODE PIXEL CIRCUIT AND DISPLAY DEVICE

(71) Applicants: Shanghai Tianma AM-OLED Co., Ltd., Shanghai (CN); Tianma Micro-Electronics Co., Ltd., Shenzhen (CN)

(72) Inventors: Li Zhang, Shanghai (CN); Xiaoxu Hu, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 0 days.

(21) Appl. No.: 14/463,593

(22) Filed: Aug. 19, 2014

(65) Prior Publication Data

US 2015/0339982 A1 Nov. 26, 2015

(30) Foreign Application Priority Data

May 21, 2014 (CN) ..... 2014 1 0217783

(51) Int. Cl.
*G09G 3/32* (2006.01)

(52) U.S. Cl.
CPC ..... *G09G 3/3291* (2013.01); *G09G 2300/0852* (2013.01); *G09G 2310/062* (2013.01); *G09G 2320/0233* (2013.01)

(58) Field of Classification Search
CPC ..... G09G 2300/0852; G09G 3/3233; G09G 2310/0251; G09G 2300/0809; G09G 2320/0233; G09G 3/3208; G09G 2310/0264; G09G 3/30; G09G 3/3283; G09G 2310/0202
USPC ..... 345/36, 39, 45–46, 76–82; 315/169.3
See application file for complete search history.

(56) References Cited

U.S. PATENT DOCUMENTS

| | | | | |
|---|---|---|---|---|
| 2004/0252089 | A1* | 12/2004 | Ono et al. | 345/82 |
| 2006/0125408 | A1* | 6/2006 | Nathan et al. | 315/169.3 |
| 2007/0152937 | A1* | 7/2007 | Jung et al. | 345/92 |
| 2009/0237378 | A1* | 9/2009 | Ohhashi et al. | 345/204 |
| 2012/0293482 | A1* | 11/2012 | Wu et al. | 345/212 |
| 2012/0327064 | A1* | 12/2012 | Qi et al. | 345/212 |
| 2013/0043796 | A1* | 2/2013 | Ko et al. | 315/151 |

FOREIGN PATENT DOCUMENTS

| | | | |
|---|---|---|---|
| CN | 102654973 | A | 9/2012 |
| CN | 103035201 | A | 4/2013 |

* cited by examiner

*Primary Examiner* — Hong Zhou
(74) *Attorney, Agent, or Firm* — Alston & Bird LLP

(57) ABSTRACT

Embodiments of the invention provide an organic light emitting diode pixel circuit and a display device so as to address such a problem of non-uniform display of an image on the entire display panel due to different threshold voltages of drive transistors in different pixel elements in a traditional organic light emitting diode pixel circuit. A drive signal generation module in the organic light emitting diode pixel circuit according to an embodiment of the invention reads and stores the threshold voltage of a drive transistor in a threshold voltage reading phase, and in a signal loading phase, receives an image data signal and generates a drive signal from the received image data signal and the threshold voltage of the drive transistor stored in the threshold voltage reading phase so that the drive signal is dependent upon the threshold voltage of the drive transistor.

10 Claims, 5 Drawing Sheets

ORGANIC LIGHT EMITTING DIODE PIXEL CIRCUIT AND DISPLAY DEVICE

CROSS-REFERENCES TO RELATED APPLICATIONS

This application claims the benefit of priority to Chinese Patent Application No. 201410217783.9, filed with the Chinese Patent Office on May 21, 2014 and entitled "ORGANIC LIGHT EMITTING DIODE PIXEL CIRCUIT AND DISPLAY DEVICE", the content of which is incorporated herein by reference in its entirety.

TECHNICAL FIELD

The present invention relates to the field of display technologies and particularly to an organic light emitting diode pixel circuit and a display device.

BACKGROUND OF THE INVENTION

An Active Matrix Organic Light Emitting Diode (AMOLED) display has been widely applied due to its wide angle of view, good color contrast effect, high response speed, low cost and other advantages. However threshold voltage drift may occur due to the problem of non-uniformity of a Thin Film Transistor (TFT) array substrate in a process flow.

A traditional 2T1C pixel circuit as illustrated in FIG. 1 includes a switch transistor T1, a drive transistor T2, a storage capacitor C1 and an Organic Light Emitting Diode (OLED), where a gate of the switch transistor T1 receives a scan signal Scan including signals on a gate line connected with the pixel circuit, a source (or a drain) of the switch transistor T1 receives an image data signal Data, the drain (or the source) of the switch transistor T1 is connected with a first terminal of the storage capacitor C1, a second terminal of the storage capacitor C1 receives a first drive signal VDD, a source of the drive transistor T2 receives a first drive signal VDD, a gate of the drive transistor T2 is connected with the first terminal of the storage capacitor C1, the drain of the drive transistor T2 is connected with a first terminal of the OLED, and the second terminal of the OLED receives a second drive signal VSS. When the gate of the switch transistor T1 receives a startup signal in the scan signal Scan, the switch transistor T1 is turned on, and the image data signal Data received by the source (or the drain) thereof is transmitted to the drain (or the source) of the switch transistor T1 and stored in the storage capacitor C1, and the operation of the drive transistor T2 is controlled by the image data signal Data and the first drive signal VDD so that the OLED is driven by drain current of the drive transistor T2 to emit light. In such 2T1C pixel circuit, since the drain current driving the OLED to emit light is dependent upon the threshold voltage of the drive transistor T2, the current driving the different OLEDs to emit light will be different even when the different OLEDs receive the same image data signal due to the different threshold voltage of the drive transistors T2 in the different pixel elements, thus resulting in non-uniform display of the entire image.

In summary, with the traditional organic light emitting diode pixel circuit, when the different OLEDs receive the same image data signal, the current driving the different OLEDs to emit light will be different due to the different threshold voltage of the drive transistors in the different pixel elements, thus resulting in non-uniform display of an image on the entire display panel.

BRIEF SUMMARY OF THE INVENTION

An embodiment of the invention provides an organic light emitting diode pixel circuit including a drive signal generation module, an OLED, a drive transistor and a switch module;

the OLED and the switch module are connected in series and then connected between a first terminal of the drive signal generation module and a first drive signal source; and a source of the drive transistor is connected with a second terminal of the drive signal generation module, a gate of the drive transistor is connected with a third terminal of the drive signal generation module, a drain of the drive transistor is connected with a fourth terminal of the drive signal generation module, the drain of the drive transistor is connected with a second drive signal source, and a fifth terminal of the drive signal generation module is connected with a data signal;

wherein the drive signal generation module is configured: in a threshold voltage reading phase, to have its first terminal connected with its second terminal and have its third terminal connected with its fourth terminal and to read and store a threshold voltage of the drive transistor from a jump from a first data signal to a second data signal received by its fifth terminal; in a signal loading phase, to have its first terminal disconnected from its second terminal and have its third terminal connected with its fourth terminal and to generate and store a drive signal from a third data signal received by its fifth terminal and the threshold voltage of the drive transistor stored by itself in the threshold voltage reading phase; in a wait phase, to have its first terminal connected with its second terminal and have its third terminal disconnected from its fourth terminal, to store the second data signal received by its fifth terminal and to control the drive transistor by the drive signal stored by itself in the signal load phase to drive the OLED to emit light; and in a light emitting phase, to have its first terminal connected with its second terminal and have its third terminal disconnected from its fourth terminal, to stop receiving the data signal and to control the drive transistor Td by the drive signal stored by itself in the signal loading phase to drive the OLED to emit light, wherein the second data signal is higher in voltage than the first data signal, and the third data signal is a data voltage signal required for display by a pixel element where the pixel circuit is located; and the switch module is configured to be turned off in both the threshold voltage reading phase and the signal loading phase and to be turned on in both the wait phase and the light emitting phase.

An embodiment of the invention provides an organic light emitting diode pixel circuits including:

an organic light emitting diode including an anode connected with a first drive signal source and a cathode connected with a first pole of a fourth switch transistor;

a first switch transistor including a gate receiving a first clock signal, a first pole connected with a second pole of the fourth switch transistor and a second pole connected with a source of a drive transistor;

a second switch transistor including a gate receiving a second clock signal, a first pole connected with a gate of the drive transistor and a second pole connected with a second drive signal source;

a third switch transistor including a gate receiving a third clock signal and a first pole connected with a data signal;

the fourth switch transistor including a gate receiving a fourth clock signal;

a first capacitor including a first pole plate connected with a second pole of the third switch transistor and a second pole plate connected with the first pole of the first switch transistor;

a second capacitor including a first pole plate connected with the first pole of the first switch transistor and a second pole plate connected with the gate of the drive transistor; and the drive transistor including a drain connected with a second drive signal source.

An embodiment of the invention provides another Organic Light Emitting Diode (OLED) pixel circuit, including:

a first switch transistor comprising a gate receiving a first clock signal, a first pole connected with a cathode of an organic light emitting diode and a second pole connected with a source of a drive transistor;

a second switch transistor comprising a gate receiving a second clock signal, a first pole connected with a gate of the drive transistor and a second pole connected with a second drive signal source;

a third switch transistor comprising a gate receiving a third clock signal and a first pole connected with a data signal;

the fourth switch transistor comprising a gate receiving a fourth clock signal and a first pole connected with a first drive signal source;

the organic light emitting diode comprising an anode connected with a second pole of the fourth switch transistor;

a first capacitor comprising a first pole plate connected with a second pole of the third switch transistor and a second pole plate connected with the first pole of the first switch transistor;

a second capacitor comprising a first pole plate connected with the first pole of the first switch transistor and a second pole plate connected with the gate of the drive transistor; and the drive transistor comprising a drain connected with the second drive signal source.

Advantageous effects of the embodiments of the invention includes the following.

With the organic light emitting diode pixel circuit according to the embodiments of the invention, in the threshold voltage reading phase, the drive signal generation module can read and store the threshold voltage of the drive transistor; and in the signal loading phase, the drive signal generation module can receive the third data signal, i.e., the data voltage signal required for display by the pixel element where the pixel circuit is located, and generate the drive signal from the received third data signal and the threshold voltage of the drive transistor stored in the threshold voltage reading phase so that the drive signal is dependent upon the threshold voltage of the drive transistor, and thus in the wait phase and the light emitting phase, when the drive transistor is controlled by the drive signal to drive the OLED to emit light, an influence of the threshold voltage of the drive transistor on drain current of the drive transistor will be cancelled by the existence of the threshold voltage in the drive signal to thereby lower the difference in current flowing through different OLEDs which receive the same image data signal and consequently the non-uniformity of display of the entire image.

DETAILED DESCRIPTION OF THE PREFERRED EMBODIMENTS

With an organic light emitting diode pixel circuit and a display device according to embodiments of the invention, a drive signal generation module, in a threshold voltage reading phase, can read and store the threshold voltage of a drive transistor and receive an image data signal and in a signal loading phase generate the drive signal from the received data signal of the frame of image and the threshold voltage of the drive transistor stored in the threshold voltage reading phase so that the drive signal is dependent upon the threshold voltage of the drive transistor, and thus when the drive transistor is controlled by the drive signal in a wait phase and a light emitting phase to drive an OLED to emit light, an influence of the threshold voltage of the drive transistor on drain current of the drive transistor will be cancelled by inclusion of the threshold voltage in the drive signal to thereby lower the difference in current flowing through different OLEDs which receive the same image data signal and consequently the non-uniformity of display of the entire image.

Particular implementations of the organic light emitting diode pixel circuit and the display device according to the embodiments of the invention will be described below with reference to the drawings.

Figure 1:
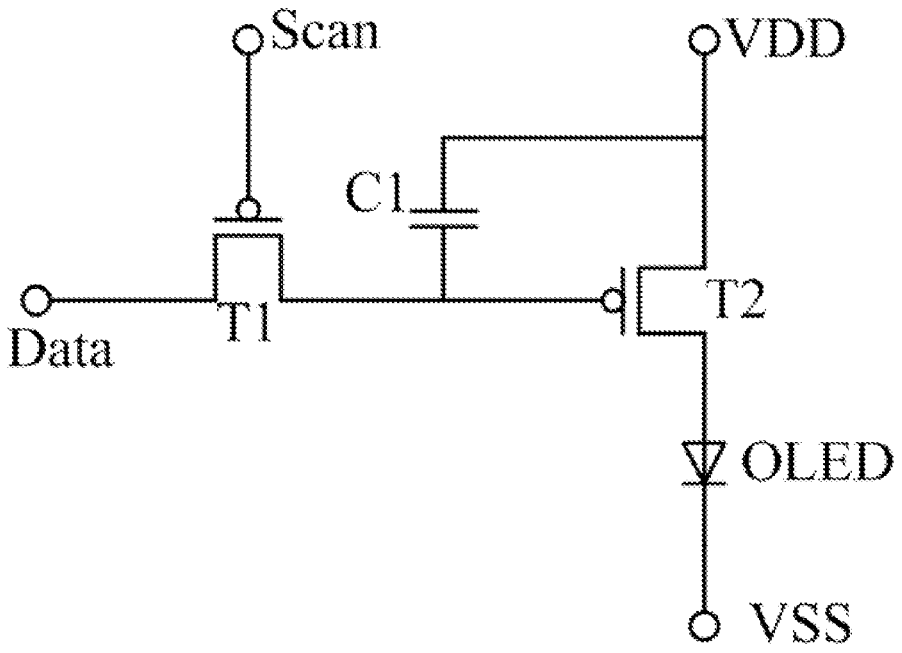
FIG. 1 is a schematic diagram of an organic light emitting diode pixel circuit in the prior art.
Figure 2A:
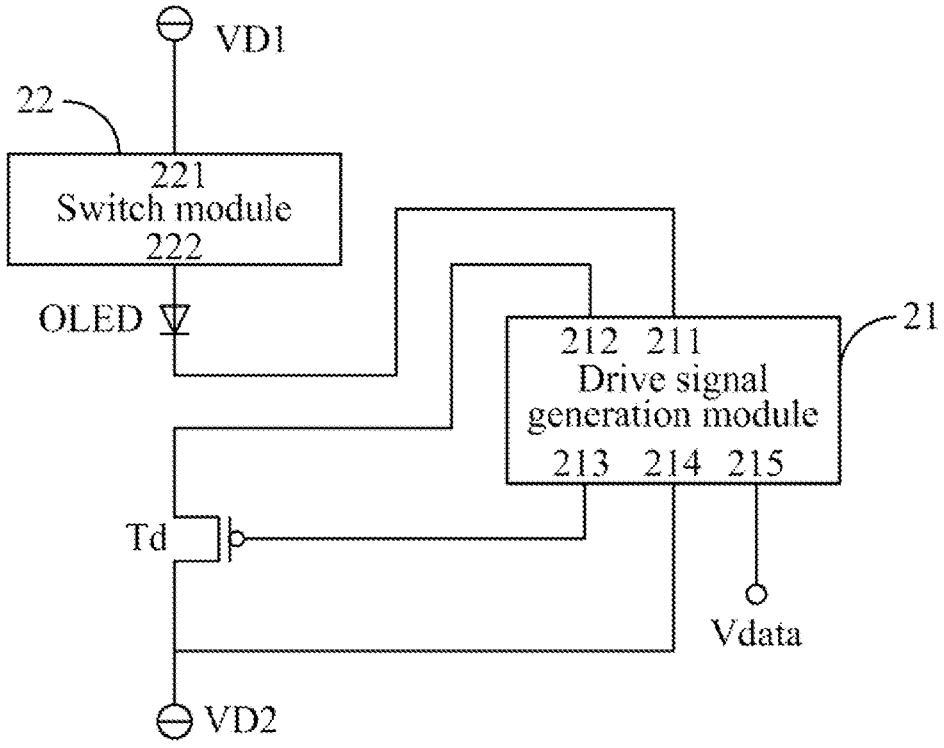
FIG. 2*a* is a schematic diagram of an organic light emitting diode pixel circuit according to a first embodiment of the invention.

An organic light emitting diode pixel circuit is provided according to a first embodiment of the invention, and FIG. 2*a* is a schematic diagram of the organic light emitting diode pixel circuit according to the first embodiment of the invention, where as illustrated in FIG. 2*a*, the organic light emitting diode pixel circuit includes a drive signal generation module 21, an OLED, a drive transistor Td and a switch module 22.

The OLED and the switch module 22 are connected in series and then connected between a first terminal 211 of the drive signal generation module 21 and a first drive signal source VD1, and particularly a first terminal 221 of the switch module 22 is connected with the first drive signal source VD1, a second terminal 222 of the switch module 22 is connected with an anode of the OLED, and a cathode of the OLED is connected with the first terminal 211 of the drive signal generation module 21.

A source of the drive transistor Td is connected with a second terminal 212 of the drive signal generation module 21, a gate of the drive transistor Td is connected with a third terminal 213 of the drive signal generation module 21, a drain of the drive transistor Td is connected with a fourth terminal 214 of the drive signal generation module 21, the drain of the drive transistor Td is further connected with a second drive signal source VD2, and a fifth terminal 215 of the drive signal generation module 21 is connected with a data signal Vdata.

Figure 4A:
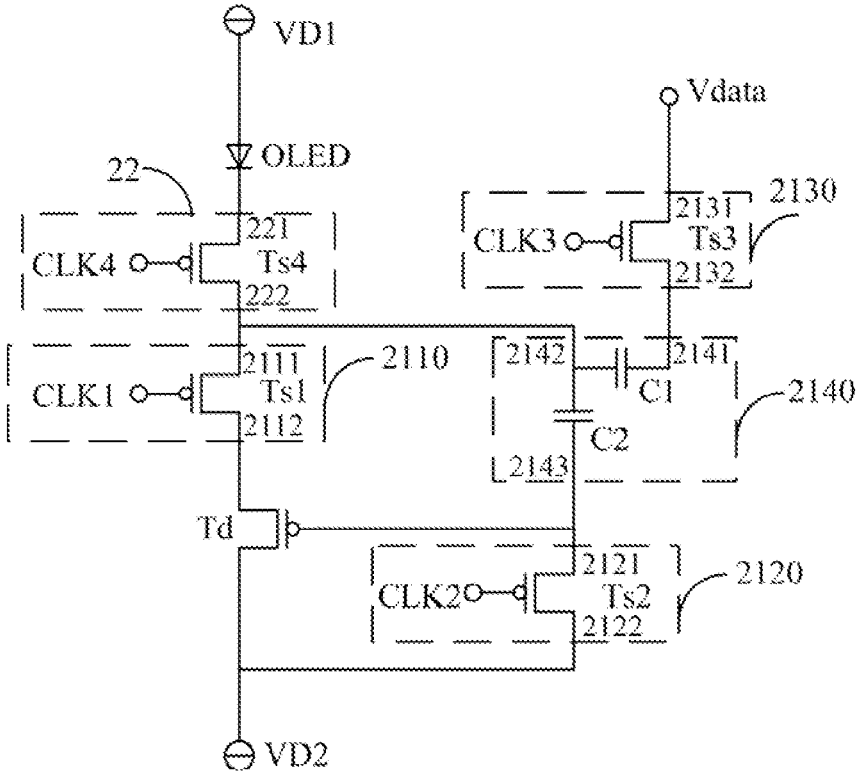
FIG. 4*a* is a schematic diagram of an organic light emitting diode pixel circuit according to a third embodiment of the invention.
Figure 4B:
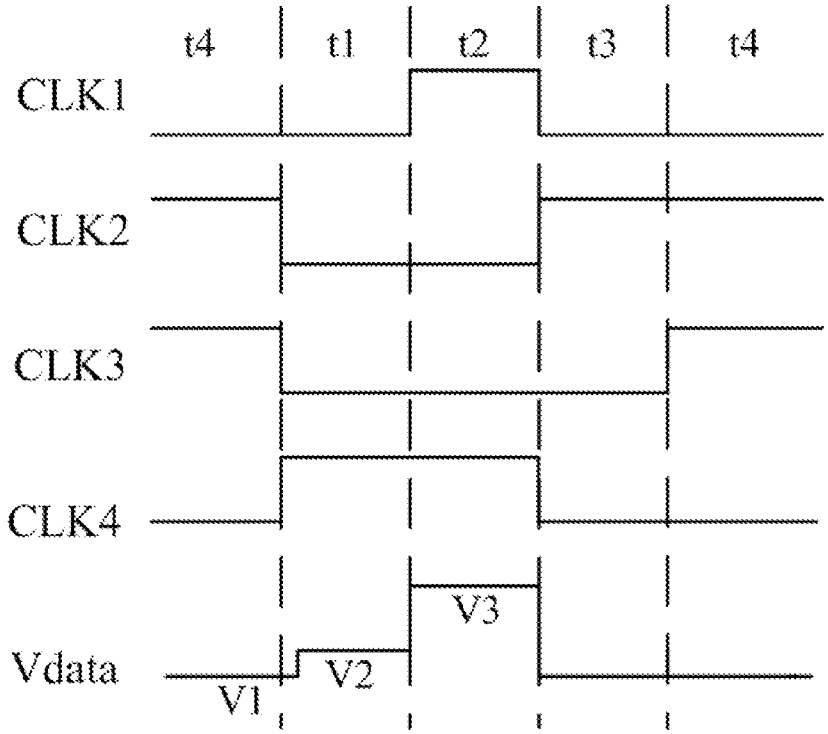
FIG. 4*b* is an operation timing diagram of the organic light emitting diode pixel circuit illustrated in FIG. 4*a* according to the third embodiment of the invention
Figure 4C:
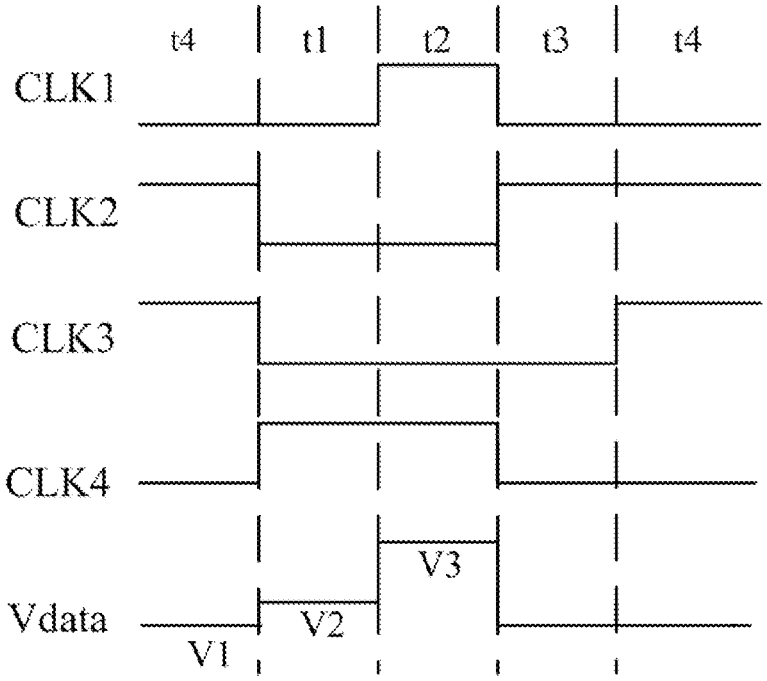
FIG. 4*c* is an alternative operation timing diagram of the organic light emitting diode pixel circuit illustrated in FIG. 4*a* according to the third embodiment of the invention.

As illustrated in FIGS. 4*b* and 4*c*, an operating period of the organic light emitting diode pixel circuit according to the first embodiment of the invention includes four periods of time: a threshold voltage reading phase, a signal loading phase, a wait phase and a light emitting phase, where the value of the data signal Vdata is changed from a first data signal V1 to a second data signal V2 in the threshold voltage reading phase; the value of the data signal Vdata is a third data signal V3 in the signal loading phase; and the value of the data signal Vdata is the first data signal V1 in the wait phase, where the second data signal V2 is higher than the first data signal V1, and the third data signal V3 is a data voltage signal required for display by a pixel element where the pixel circuit is located.

The drive signal generation module 21 is configured, in the threshold voltage reading phase, to have its first terminal 211 connected with its second terminal 212 and have its third terminal 213 connected with its fourth terminal 214 and to change the value of the data signal Vdata from the first data signal V1 to the second data signal V2, particularly in the threshold voltage reading phase by providing firstly the first data signal V1 and then the second data signal V2 and reading and storing the threshold voltage of the drive transistor Td; the drive signal generation module 21 is configured, in the signal loading phase, to have its first terminal 211 disconnected from its second terminal 212 and have its third terminal 213 connected with its fourth terminal 214 and to generate and store a drive signal from the third data signal V3 received by its fifth terminal 215 and the threshold voltage of the drive transistor Td stored by itself in the threshold voltage reading phase; the drive signal generation module 21 is configured, in the wait phase, to have its first terminal 211 connected with its second terminal 212 and have its third terminal 213 disconnected from its fourth terminal 214, to store the first data signal V1 received by its fifth terminal 215 and to control the drive transistor Td by the drive signal stored by itself in the signal loading phase to drive the OLED to emit; and the drive signal generation module 21 is configured, in the light emitting phase, to have its first terminal 211 connected with its second terminal 212 and have its third terminal 213 disconnected from its fourth terminal 214, to stop receiving the data signal Vdata and to control the drive transistor Td by the drive signal stored by itself in the signal loading phase to drive the OLED to emit light.

The switch module 22 is configured to be turned off in both the threshold voltage reading phase and the signal loading phase and to be turned on in both the wait phase and the light emitting phase.

The first drive signal source VD1 outputs a high-level signal Vdd, and the second drive signal source VD2 outputs a low-level signal Vss.

It shall be noted that the change in voltage from the first data signal V1 to the second data signal V2 takes place in the threshold voltage reading phase primarily for the purpose of reading the threshold voltage of the drive transistor Td by changing the data signal, and particularly as described in the first embodiment of the invention, firstly the first data signal V1 and then the second data signal V2 can be provided in the threshold voltage reading phase; or the first data signal V1 can be provided before the threshold voltage reading phase and the second data signal V2 can be provided in the threshold voltage reading phase.

Figure 2B:
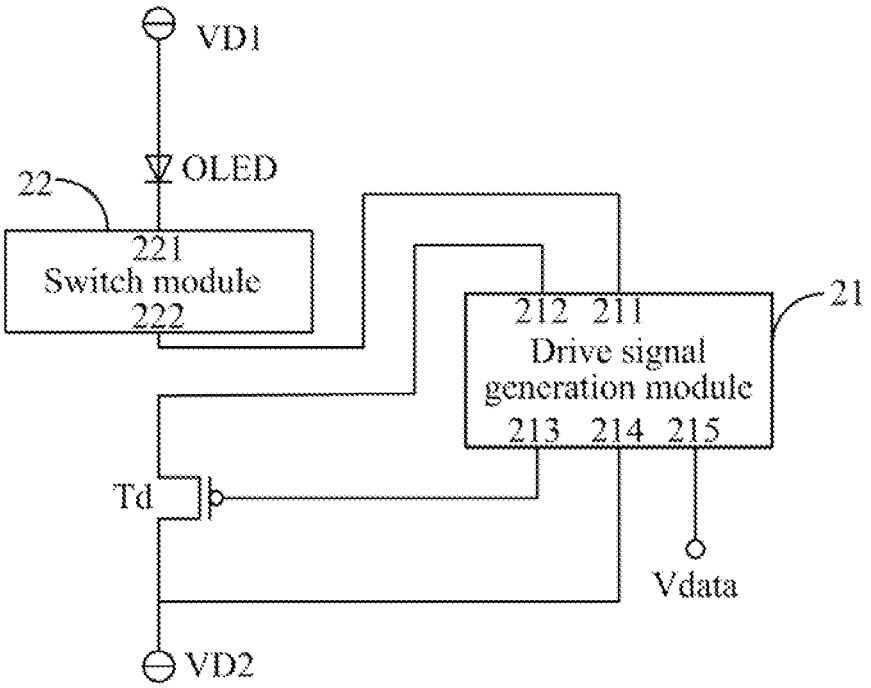
FIG. 2*b* is a schematic diagram of another organic light emitting diode pixel circuit according to the first embodiment of the invention.

FIG. 2*b* is a schematic diagram of another organic light emitting diode pixel circuit according to the first embodiment of the invention, where in FIG. 2*b*, the OLED and the switch module 22 are connected in series and then connected between the first terminal 211 of the drive signal generation module 21 and the first drive signal source VD1, and particularly the first drive signal source VD1 is connected with the anode of the OLED, the cathode of the OLED is connected with the first terminal 221 of the switch module 22, and the second terminal 222 of the switch module 22 is connected with the first terminal 211 of the drive signal generation module 21.

The organic light emitting diode pixel circuit according to the first embodiment of the invention operates under the same principle regardless of whether the structure thereof illustrated in FIG. 2*a* or the structure thereof illustrated in FIG. 2*b* is adopted, and the structure of the drive signal generation module in FIG. 2*b* can be the same as the structure of the drive signal generation module in FIG. 2*a*, and the structure of the switch module in FIG. 2*b* can be the same as the structure of the switch module in FIG. 2*a*.

Figure 3:
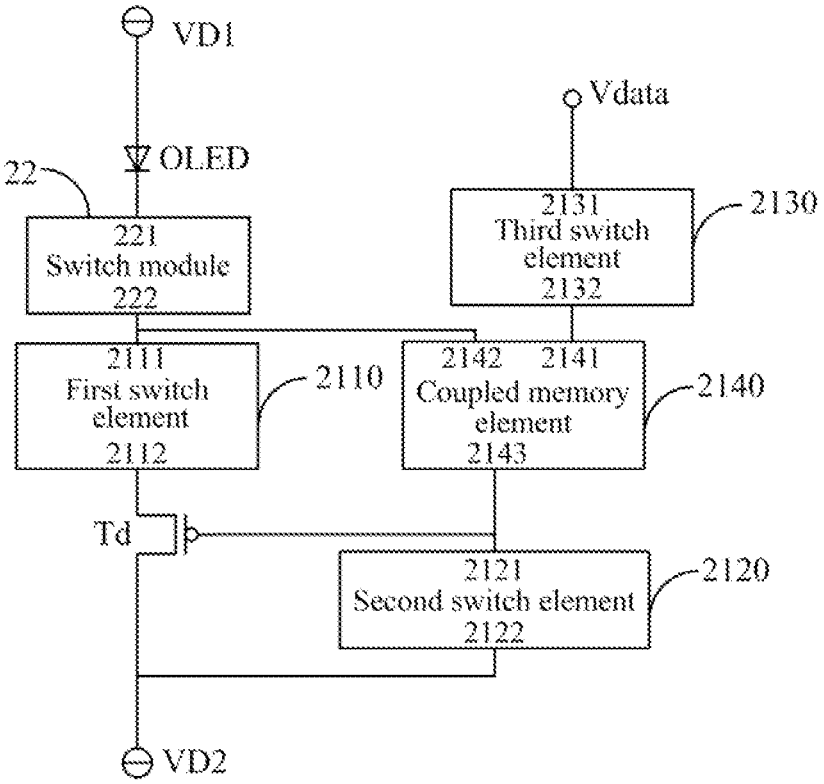
FIG. 3 is a schematic diagram of an organic light emitting diode pixel circuit according to a second embodiment of the invention.

FIG. 3 illustrates a structure of an organic light emitting diode pixel circuit according to a second embodiment of the invention, and as compared with the organic light emitting diode pixel circuit according to the first embodiment, the drive signal generation module is divided into a plurality of functional elements, and particularly the drive signal generation module includes a first switch element 2110, a second switch element 2120, a third switch element 2130 and a coupled memory element 2140.

A first terminal 2111 of the first switch element 2110 is equivalent to the first terminal of the drive signal generation module and connected with the second terminal 222 of the switch module 22; and a second terminal 2112 of the first switch element 2110 is equivalent to the second terminal of the drive signal generation module and connected with the source of the drive transistor Td.

A first terminal 2121 of the second switch element 2120 is equivalent to the third terminal of the drive signal generation module and connected with the gate of the drive transistor Td; and a second terminal 2122 of the second switch element 2120 is equivalent to the fourth terminal of the drive signal generation module and connected with the drain of the drive transistor Td.

A first terminal 2131 of the third switch element 2130 is equivalent to the fifth terminal of the drive signal generation module and connected with the data signal Vdata; and a second terminal 2132 of the third switch element 2130 is connected with a first terminal 2141 of the coupled memory element 2140.

A second terminal 2142 of the coupled memory element 2140 is equivalent to the first terminal of the drive signal generation module and connected with the second terminal 222 of the switch module 22; and a third terminal 2143 of the coupled memory element 2140 is equivalent to the third terminal of the drive signal generation module and connected with the gate of the drive transistor Td.

As illustrated in FIGS. 4*b* and 4*c*, an operating period of the organic light emitting diode pixel circuit according to the second embodiment of the invention also includes four periods of time: a threshold voltage reading phase, a signal loading phase, a wait phase and a light emitting phase, where the value of the data signal Vdata is changed from the first data signal V1 to the second data signal V2 in the threshold voltage reading phase; the value of the data signal Vdata is the third data signal V3 in the signal loading phase; and the value of the data signal Vdata is the first data signal V1 in the wait phase, where the second data signal V2 is higher than the first data signal V1, and the third data signal V3 is the data voltage signal required for display by the pixel element where the pixel circuit is located.

The first switch element 2110 is configured to be turned on in all of the threshold voltage reading phase, the wait phase and the light emitting phase and to be turned off in the signal loading phase.

The second switch element 2120 is configured to be turned on in both the threshold voltage reading phase and the signal loading phase and to be turned off in both the wait phase and the light emitting phase.

The third switch element 2130 is configured to be turned on in all of the threshold voltage reading phase, the signal loading phase and the wait phase and to be turned off in the light emitting phase.

The coupled memory element 2140 is configured, in the threshold voltage reading phase, to receive the change in value of the data signal Vdata from the first data signal V1 to the second data signal V2 at the first terminal 2141, to couple the voltage change at its first terminal 2141, i.e., V2−V1, to its second terminal 2142 so that the voltage at its second terminal 2142 is higher than the difference between the voltage at its third terminal 2143 and the threshold voltage of the drive transistor Td and to read and store the threshold voltage of the drive transistor Td; the coupled memory element 2140 is configured, in the signal loading phase, to receive the third data signal V3 at its first terminal 2141, to couple the voltage change at its first terminal 2141, i.e., V3−V2, to its second terminal 2142 and to generate and store the drive signal from the received third data signal V3 and the threshold voltage of the drive transistor Td stored in the threshold voltage reading phase; the coupled memory element 2140 is configured, in the wait phase, to receive and store the second voltage signal V2 at its first terminal 2141 and to control the drive transistor Td by the drive signal stored in the signal loading phase to drive the OLED; and the coupled memory element 2140 is configured, in the light emitting phase, to control the drive transistor by the drive signal stored in the signal loading phase to drive the OLED to emit light.

All of the first switch element 2110, the second switch element 2120 and the third switch element 2130 are turned on and the switch module 22 is turned off in the current threshold voltage reading phase. Since the second switch element 2120 is turned on, the gate voltage of the drive transistor Td is the low-level signal Vss output by the second drive signal source VD2 so that initialization is completed to remove an influence of a signal in a previous light emission on current light emission.

In the current threshold voltage reading phase, the data signal received at the first terminal 2131 of the third switch element 2130 jumps from the first data signal V1 to the second data signal V2, and since the threshold voltage of the drive transistor Td needs to be read in the case that the value of the source voltage of the drive transistor Td is higher the difference between the gate voltage thereof and the threshold voltage thereof, and V1 is lower than V2, so that in the current threshold voltage reading phase, the voltage change at the first terminal 2141 of the coupled memory element 2140 is V2−V1, and further the voltage change of the source of the drive transistor Td is higher than the voltage change of the gate of the drive transistor Td by V2−V1 to thereby ensure that in the threshold voltage reading phase, the source voltage of the drive transistor Td is higher than the difference between the gate voltage of the drive transistor Td and the threshold voltage of the drive transistor Td to thereby read the threshold voltage of the drive transistor Td.

In summary, the organic light emitting diode pixel circuit according to the embodiment of the invention actually performs two functions in the threshold voltage reading phase including initialization and threshold voltage reading. The organic light emitting diode pixel circuit according to the embodiment of the invention also performs two functions in the wait phase including preparing for a next time of reading the threshold voltage of the drive transistor Td and light emission.

FIG. 4*a* illustrates an organic light emitting diode pixel circuit according to a third embodiment of the invention, where the switch module 22 includes a fourth switch transistor Ts4; and a first pole of the fourth switch transistor Ts4 is the first terminal 221 of the switch module 22, a gate of the fourth switch transistor Ts4 receives a fourth clock signal CLK4, and a second pole of the fourth switch transistor Ts4 is the second terminal 222 of the switch module 22. The fourth switch transistor Ts4 is configured to be turned off in both the threshold voltage reading phase and the signal loading phase and to be turned on in both the wait phase and the light emitting phase.

The first switch element 2110 includes a first switch transistor Ts1, where a first pole of the first switch transistor Ts1 is the first terminal 2111 of the first switch element 2110, a gate of the first switch transistor Ts1 receives a first clock signal CLK1, and a second pole of the first switch transistor Ts1 is the second terminal 2112 of the first switch element 2110; and the first switch transistor Ts1 is configured to be turned on in all of the threshold voltage reading phase, the wait phase and the light emitting phase and to be turned off in the signal loading phase.

The second switch element 2120 includes a second switch transistor Ts2, where a first pole of the second switch transistor Ts2 is the first terminal 2121 of the second switch element 2120, a gate of the second switch transistor Ts2 receives a second clock signal CLK2, and a second pole of the second switch transistor Ts2 is the second terminal 2122 of the second switch element 2120; and the second switch transistor Ts2 is configured to be turned on in both the threshold voltage reading phase and the signal loading phase and to be turned off in both the wait phase and the light emitting phase.

The third switch element 2130 includes a third switch transistor Ts3, where a first pole of the third switch transistor Ts3 is the first terminal 2131 of the third switch element 2130, a gate of the third switch transistor Ts3 receives a third clock signal CLK3, and a second pole of the third switch transistor Ts3 is the second terminal 2132 of the third switch element 2130; and the third switch transistor Ts3 is configured to be turned on in all of the threshold voltage reading phase, the signal loading phase and the wait phase and to be turned off in the light emitting phase.

The coupled memory element 2140 includes a first capacitor C1 and a second capacitor C2, where a first terminal of the first capacitor C1 is the first terminal 2141 of the coupled memory element 2140, a second terminal of the first capacitor C1 is the second terminal 2142 of the coupled memory element 2140, a first terminal of the second capacitor C2 is also the second terminal 2142 of the coupled memory element 2140, and a second terminal of the second capacitor C2 is the third terminal 2143 of the coupled memory element 2140.

FIG. 4*b* is an operation timing diagram of the organic light emitting diode pixel circuit illustrated in FIG. 4*a*. An operation principle of the organic light emitting diode pixel circuit according to the third embodiment of the invention will be described below with reference to FIG. 4*a* and FIG. 4*b*.

As illustrated in FIG. 4*b*, an operating period of the organic light emitting diode pixel circuit according to the third embodiment of the invention includes four periods of time: a threshold voltage reading phase t1, a signal loading phase t2, a wait phase t3 and a light emitting phase t4, where the value of the data signal Vdata is changed from the first data signal V1 to the second data signal V2 in the threshold voltage reading phase t1; and the value of the data signal Vdata is the third data signal V3 in the signal loading phase t2; wherein the second data signal V2 is higher than the first data signal V1, and the third data signal V3 is a data voltage signal required for display of the frame.

In the threshold voltage reading phase t1, the fourth switch transistor Ts4 is controlled by the fourth clock signal CLK4 at the high level to be turned off, and the first switch transistor Ts1, the second switch transistor Ts2 and the third switch transistor Ts3 are controlled respectively by the first clock signal CLK1, the second clock signal CLK2 and the third clock signal CLK3 at the low level to be turned on. The voltage Vss of the second drive signal source VD2 is transmitted to the gate of the drive transistor Td through the second switch transistor Ts2, so the gate voltage Vg of the drive transistor Td is equal to Vss.

At this time, the value of the data signal Vdata is changed from the first data signal V1 to the second data signal V2 with V2 is higher than V1, and as the voltage at the first terminal of the first capacitor C1, i.e., the first terminal 2141 of the coupled memory element 2140, increases, the first capacitor C1 and the second capacitor C2 are discharged through the first switch transistor Ts1 and the drive transistor Td and stop being discharged until the difference between the voltage $V_{n1}$ at the second terminal 2142 of the coupled memory element 2140 and the gate voltage Vg of the drive transistor Td is Vth, where Vth is the threshold voltage of the drive transistor Td, and at this time:

$$V_{n1}=Vss+|Vth| \tag{1}$$

In the signal loading phase t2, the first switch transistor Ts1 is turned off, the second switch transistor Ts2 is turned on, the third switch transistor Ts3 is turned on, and the fourth switch transistor Ts4 is turned off, and the data signal Vdata connected with the third switch transistor Ts3 jumps from the second data signal V2 to the third data signal V3 which is a data signal required for display of an image by the pixel element where the pixel circuit is located. The voltage at the first terminal of the first capacitor C1 connected with the third switch transistor Ts3 jumps by a voltage change ΔV1 which is V3−V2, so the voltage at the second terminal of the first capacitor C1 will also jump by a voltage change ΔV2 as follows:

$$\Delta V2 = \frac{(V3 - V2)\times c1}{c1 + c2} \tag{2}$$

Wherein, c1 is the capacitance of the first capacitor, and c2 is the capacitance of the second capacitor. Then at this time, the voltage $V_{n2}$ at the second terminal 2142 of the coupled memory element 2140 is the voltage $V_{n1}$ at the second terminal 2142 of the coupled memory element 2140, before the data signal Vdata is changed, added by the voltage change ΔV2:

$$V_{n2} = Vss + |Vth| + \frac{(V3 - V2)\times c1}{c1 + c2} \tag{3}$$

At this time, the voltage difference across the second capacitor C2, i.e., the voltage difference Vgs between the gate and the source of the drive transistor Td is equal to:

$$Vgs = V_{n2} - Vss = |Vth| + \frac{(V3 - V2)\times c1}{c1 + c2} \tag{4}$$

In the wait phase t3, the data signal Vdata connected with the third switch transistor Ts3 jumps from the data signal V3, which is the data signal required for display of image by the pixel element, to the first data signal V1, and since the third switch transistor Ts3 is turned on, the voltage at the terminal of the first capacitor C1 connected with the third switch transistor Ts3 jumps from the third data signal V3 to the first data signal V1, but since at this time the second switch transistor Ts2 is turned off, the voltage difference across the second capacitor C2 is not changed. Since the first switch transistor Ts1 is turned on, the voltage difference Vgs between the gate and the source of the drive transistor Td is equal to the voltage difference across the second capacitor C2, so the voltage difference Vgs between the gate and the source of the drive transistor Td is not changed, and also since the fourth switch transistor Ts4 is turned on, the OLED emits light. The value of stable current $I_{OLED}$ flowing through the Organic Light Emitting Diode (OLED) can be calculated in the following equation of the characteristic of current of a transistor operating in a saturation region:

$$I_{OLED} = \frac{1}{2}k(Vgs - Vth)^2 = \frac{1}{2}k\left(\frac{(V3 - V2)\times c1}{c1 + c2}\right)^2 \tag{5}$$

Wherein, k is dependent upon a structural parameter of the drive transistor Td, Vth is the threshold voltage of the drive transistor Td, c1 is the capacitance of the first capacitor, and c2 is the capacitance of the second capacitor.

As can be apparent, the current $I_{OLED}$ flowing through the Organic Light Emitting Diode (OLED) is independent of the threshold voltage of the drive transistor Td, thus overcoming such a problem that with the traditional OLED pixel circuit, even when of the different OLEDs receive the same image data signal, the current, which drive the different OLEDs to emit light, are different due to the different threshold voltage of the drive transistors in the different pixel elements, and addressing the problem of the different pixel units being driven by different current to emit light upon reception of the same image data signal and improving the uniformity of display.

In the light emitting phase t4, since the third switch transistor Ts3 is turned off, the voltage at the terminal of the first capacitor C1 connected with the third switch transistor Ts3 is maintained at V2, and since the second switch transistor Ts2 is turned off, the voltage difference across the second capacitor C2 is not changed; and since the first switch transistor Ts1 is turned on, the voltage difference Vgs between the gate and the source of the drive transistor Td is equal to the voltage difference across the second capacitor C2, so the voltage difference Vgs between the gate and the source of the drive transistor Td is not changed, and also since the fourth switch transistor Ts4 is turned on, the OLED emits light.

It shall be noted that the voltage change from the first data signal V1 to the second data signal V2 takes place in the threshold voltage reading phase primarily for the purpose of reading the threshold voltage of the drive transistor Td by changing the data signal, and particular timing of driving can be as illustrated in FIG. 4*b* where firstly the first data signal V1 and then the second data signal V2 are provided in the threshold voltage reading phase. Alternatively, as illustrated in FIG. 4*c*, the first data signal V1 is provided before the threshold voltage reading phase and the second data signal V2 is provided in the threshold voltage reading phase, wherein the first data signal V1 provided before the threshold voltage reading phase can be a data signal provided in the signal loading phase t3 of a previous frame.

Figure 5:
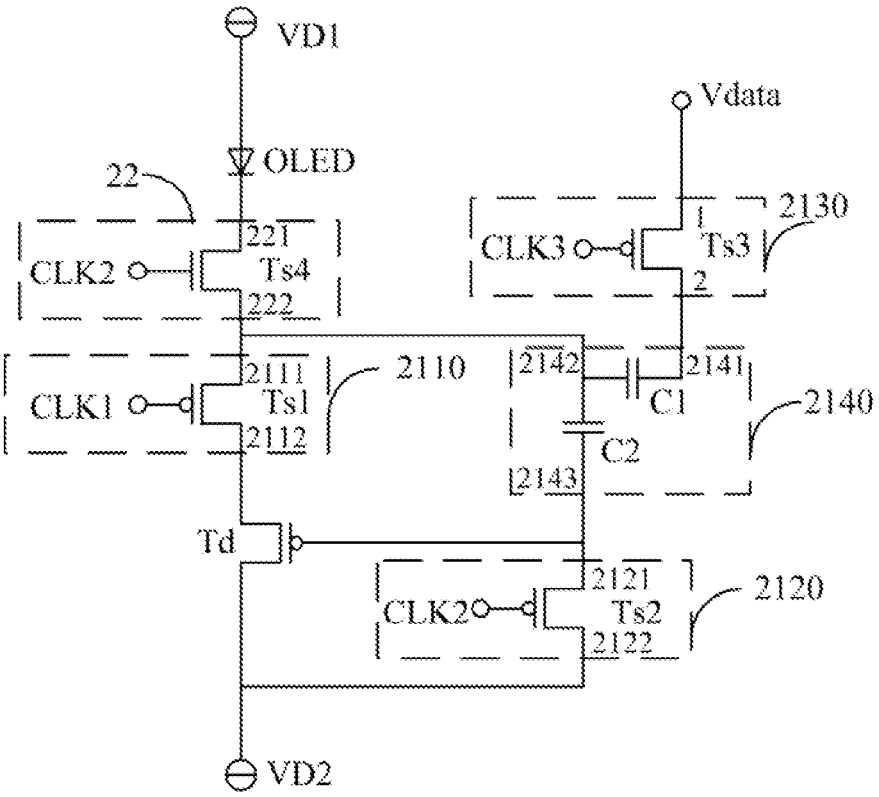
FIG. 5 is a schematic diagram of the organic light emitting diode pixel circuit according to the third embodiment of the invention.

FIG. 5 illustrates another organic light emitting diode pixel circuit according to the third embodiment of the invention, where the fourth switch transistor Ts4 is a p-type transistor in FIG. 4*a*, and the fourth switch transistor Ts4 is an n-type transistor in FIG. 5. In FIG. 5, the second switch transistor Ts2 and the fourth switch transistor Ts4 can be connected with the same clock signal. In the threshold voltage reading phase t1 and the signal loading phase t2, the second switch transistor Ts2 is controlled by the clock signal at the low level to be turned off, and the fourth switch transistor Ts4 is controlled by the clock signal at the low level to be turned on; and in the wait phase t3 and the light emitting phase t4, the second switch transistor Ts2 is controlled by the clock signal at the high level to be turned on, and the fourth switch transistor Ts4 is controlled by the clock signal at the high level to be turned off, thus achieving the same effect as the timing of driving in FIG. 4*b* or FIG. 4*c* while dispensing with one input signal and simplifying the structure.

Figure 6:
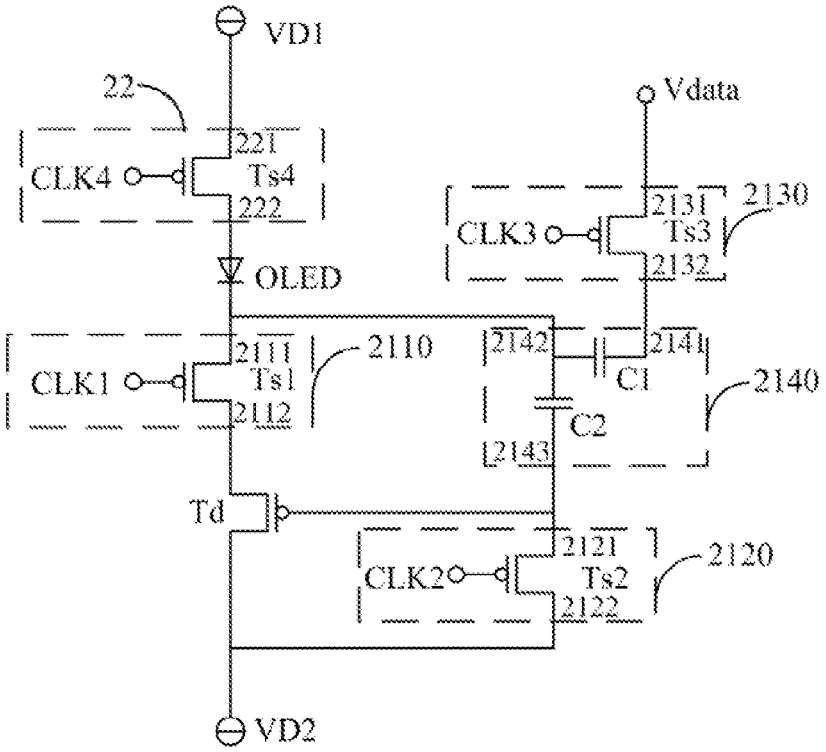
FIG. 6 is a schematic diagram of an organic light emitting diode pixel circuit according to a fourth embodiment of the invention.

FIG. 6 illustrates an organic light emitting diode pixel circuit according to a fourth embodiment of the invention, which includes:

A first switch transistor Ts1, which includes a gate receiving a first clock signal CLK1, a first pole connected with a cathode of an Organic Light Emitting Diode (OLED) and a second pole connected with a source of a drive transistor Td;

A second switch transistor Ts2, which includes a gate receiving a second clock signal CLK2, a first pole connected with a gate of the drive transistor Td and a second pole connected with a second drive signal source VD2, where the second switch transistor Ts2 is a p-type transistor;

A third switch transistor Ts3, which includes a gate receiving a third clock signal CLK3 and a first pole connected with a data line Ldata;

A fourth switch transistor Ts4, which includes a gate receiving a fourth clock signal CLK4 and a first pole connected with a first drive signal source VD1, where the fourth switch transistor Ts4 is a p-type transistor;

The Organic Light Emitting Diode (OLED), which includes an anode connected with a second pole of the fourth switch transistor Ts4;

A first capacitor C1, which includes one pole plate connected with a second pole of the third switch transistor Ts3 and the other pole plate connected with the first pole of the first switch transistor Ts1;

A second capacitor C2, which includes one pole plate connected with the first pole of the first switch transistor Ts1 and the other pole plate connected with the gate of the drive transistor Td; and The drive transistor Td, which includes a drain connected with the second drive signal source VD2.

Figure 7:
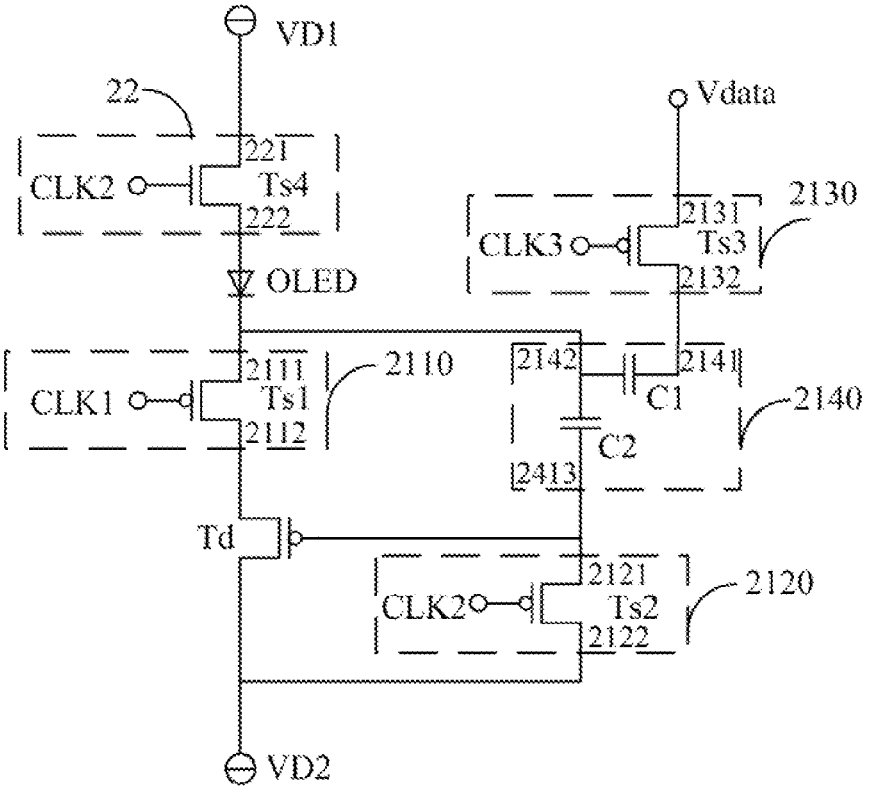
FIG. 7 is a schematic diagram of another organic light emitting diode pixel circuit according to the fourth embodiment of the invention.

FIG. 7 illustrates another organic light emitting diode pixel circuit according to the fourth embodiment of the invention, compared with the organic light emitting diode pixel circuit of FIG. 6, the fourth switch transistor Ts4 is an n-type transistor. In the threshold voltage reading phase t1 and the signal loading phase t2, the second switch transistor Ts2 is controlled by the clock signal at the low level to be turned off, and the fourth switch transistor Ts4 is controlled by the clock signal at the low level to be turned on; and in the wait phase t3 and the light emitting phase t4, the second switch transistor Ts2 is controlled by the clock signal at the high level to be turned on, and the fourth switch transistor Ts4 is controlled by the clock signal at the high level to be turned off, thus achieving the same effect as the timing of driving in FIG. 4*b* or FIG. 4*c* while dispensing with one input signal and simplifying the structure.

A first pole of a switch transistor as referred to in the embodiments of the invention can be a source (or a drain) of the switch transistor, and a second pole of the switch transistor can be the drain (or the source) of the switch transistor. If the source of the switch transistor is the first pole, then the drain of the switch transistor is the second pole; and if the drain of the switch transistor is the first pole, then the source of the switch transistor is the second pole.

Those skilled in the art can appreciate that the drawings are merely schematic diagrams of some preferred embodiments of the invention and the modules or flows in the drawings may not be necessarily required to implement the invention.

Those skilled in the art can appreciate that the modules in devices according to the embodiments can be distributed in the devices of the embodiments as described in the embodiments or located in one or more devices other than these embodiments while being modified correspondingly. The modules in the foregoing embodiments can be combined into a module or further divided into a plurality of sub-modules.

The foregoing embodiments of the invention have been numbered merely for the convenience of their description but will not indicate any precedence of one embodiment over the other.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

What is claimed is:

1. An Organic Light Emitting Diode (OLED) pixel circuit, comprising a drive signal generation module, an OLED, a drive transistor and a switch module, wherein:

the OLED and the switch module are connected in series and then connected between a first terminal of the drive signal generation module and a first drive signal source;

a source of the drive transistor is connected with a second terminal of the drive signal generation module, a gate of the drive transistor is connected with a third terminal of the drive signal generation module, a drain of the drive transistor is connected with a fourth terminal of the drive signal generation module, the drain of the drive transistor is connected with a second drive signal source, and a fifth terminal of the drive signal generation module is connected with a data signal;

wherein the drive signal generation module is configured:

in a threshold voltage reading phase, to have its first terminal connected with its second terminal and have its third terminal connected with its fourth terminal and to read and store a threshold voltage of the drive transistor from a jump from a first data signal to a second data signal received by its fifth terminal;

in a signal loading phase, to have its first terminal disconnected from its second terminal and have its third terminal connected with its fourth terminal and to generate and store a drive signal from a third data signal received by its fifth terminal and the threshold voltage of the drive transistor stored by itself in the threshold voltage reading phase;

in a wait phase, to have its first terminal connected with its second terminal and have its third terminal disconnected from its fourth terminal, to store the second data signal received by its fifth terminal and to control the drive transistor by the drive signal stored by itself in the signal loading phase to drive the OLED to emit light; and in a light emitting phase, to have its first terminal connected with its second terminal and have its third terminal disconnected from its fourth terminal, to stop receiving the data signal and to control the drive transistor Td by the drive signal stored by itself in the signal loading phase to drive the OLED to emit light, wherein the second data signal is higher in voltage than the first data signal, and the third data signal is a data voltage signal required for display by a pixel element where the pixel circuit is located; and the switch module is configured to be turned off in both the threshold voltage reading phase and the signal loading phase and to be turned on in both the wait phase and the light emitting phase.

2. The circuit according to claim 1, wherein:

the drive signal generation module comprises a first switch element, a second switch element, a third switch element and a coupled memory element;

a first terminal of the first switch element is the first terminal of the drive signal generation module, and a second terminal of the first switch element is the second terminal of the drive signal generation module;

a first terminal of the second switch element is the third terminal of the drive signal generation module, and a second terminal of the second switch element is the fourth terminal of the drive signal generation module;

a first terminal of the third switch element is the fifth terminal of the drive signal generation module, and a second terminal of the third switch element is connected with a first terminal of the coupled memory element; and a second terminal of the coupled memory element is the first terminal of the drive signal generation module, and a third terminal of the coupled memory element is the third terminal of the drive signal generation module;

the first switch element is configured to be turned on in all of the threshold voltage reading phase, the wait phase and the light emitting phase and to be turned off in the signal loading phase;

the second switch element is configured to be turned on in both the threshold voltage reading phase and the signal loading phase and to be turned off in both the wait phase and the light emitting phase;

the third switch element is configured to be turned on in all of the threshold voltage reading phase, the signal loading phase and the wait phase and to be turned off in the light emitting phase; and the coupled memory element is configured:

in the threshold voltage reading phase, to receive the jump from the first data signal to the second data signal at its first terminal, to couple a voltage change at its first terminal to its second terminal so that a voltage at its second terminal is higher than a difference between the voltage at its third terminal and the threshold voltage of the drive transistor and to read and store the threshold voltage of the drive transistor;

in the signal loading phase, to receive the third data signal at its first terminal, to couple the voltage change at its first terminal to its second terminal and to generate and store the drive signal from the received third data signal and the threshold voltage of the drive transistor stored in the threshold voltage reading phase;

in the wait phase, to receive and store the first data signal at its first terminal and to control the drive transistor by the drive signal stored in the signal loading phase to drive the OLED to emit light; and in the light emitting phase, to control the drive transistor by the drive signal stored in the signal loading phase to drive the OLED to emit light.

3. The circuit according to claim 2, wherein:

the first switch element comprises a first switch transistor;

a first pole of the first switch transistor is the first terminal of the first switch element, a gate of the first switch transistor receives a first clock signal, and a second pole of the first switch transistor is the second terminal of the first switch element; and the first switch transistor is configured to be turned on in all of the threshold voltage reading phase, the wait phase and the light emitting phase and to be turned off in the signal loading phase.

4. The circuit according to claim 2, wherein:

the second switch element comprises a second switch transistor;

a first pole of the second switch transistor is the first terminal of the second switch element, a gate of the second switch transistor receives a second clock signal, and a second pole of the second switch transistor is the second terminal of the second switch element; and the second switch transistor is configured to be turned on in both the threshold voltage reading phase and the signal loading phase and to be turned off in both the wait phase and the light emitting phase.

5. The circuit according to claim 2, wherein:

the third switch element comprises a third switch transistor;

a first pole of the third switch transistor is the first terminal of the third switch element, a gate of the third switch transistor receives a third clock signal, and a second pole of the third switch transistor is the second terminal of the third switch element; and the third switch transistor is configured to be turned on in all of the threshold voltage reading phase, the signal loading phase and the wait phase and to be turned off in the light emitting phase.

6. The circuit according to claim 2, wherein:

the coupled memory element comprises a first capacitor and a second capacitor; and a first terminal of the first capacitor is the first terminal of the coupled memory element, a second terminal of the first capacitor is the second terminal of the coupled memory element, a first terminal of the second capacitor is the second terminal of the coupled memory element, and a second terminal of the second capacitor is the third terminal of the coupled memory element.

7. The circuit according to claim 1, wherein the OLED and the switch module are connected in series and then connected between the first terminal of the drive signal generation module and the first drive signal source as follows:

the first drive signal source is connected with a first terminal of the switch module, and a second terminal of the switch module is connected sequentially with the OLED and the first terminal of the drive signal generation module; or the first drive signal source is connected sequentially with the OLED and the first terminal of the switch module, and the second terminal of the switch module is connected with the first terminal of the drive signal generation module.

8. The circuit according to claim 7, wherein:

the switch module comprises a fourth switch transistor;

a first pole of the fourth switch transistor is the first terminal of the switch module, a gate of the fourth switch transistor receives a fourth clock signal, and a second pole of the fourth switch transistor is the second terminal of the switch module; and the fourth switch transistor is configured to be turned off in both the threshold voltage reading phase and the signal loading phase and to be turned on in both the wait phase and the light emitting phase.

9. An Organic Light Emitting Diode (OLED) pixel circuit, comprising:

an organic light emitting diode comprising an anode connected with a first drive signal source and a cathode connected with a first pole of a fourth switch transistor;

a first switch transistor comprising a gate receiving a first clock signal, a first pole connected with a second pole of the fourth switch transistor and a second pole connected with a source of a drive transistor;

a second switch transistor comprising a gate receiving a second clock signal, a first pole connected with a gate of the drive transistor and a second pole directly connected with a second drive signal source;

a third switch transistor comprising a gate receiving a third clock signal and a first pole connected with a data signal;

the fourth switch transistor comprising a gate receiving a fourth clock signal;

a first capacitor comprising a first pole plate connected with a second pole of the third switch transistor and a second pole plate directly connected with the first pole of the first switch transistor;

a second capacitor comprising a first pole plate connected with the first pole of the first switch transistor and a second pole plate connected with the gate of the drive transistor; and the drive transistor comprising a drain connected with a second drive signal source.

10. An Organic Light Emitting Diode (OLED) pixel circuit, comprising:

a first switch transistor comprising a gate receiving a first clock signal, a first pole connected with a cathode of an organic light emitting diode and a second pole connected with a source of a drive transistor;

a second switch transistor comprising a gate receiving a second clock signal, a first pole connected with a gate of the drive transistor and a second pole directly connected with a second drive signal source;

a third switch transistor comprising a gate receiving a third clock signal and a first pole connected with a data signal;

a fourth switch transistor comprising a gate receiving a fourth clock signal and a first pole connected with a first drive signal source;

the organic light emitting diode comprising an anode connected with a second pole of the fourth switch transistor;

a first capacitor comprising a first pole plate directly connected with a second pole of the third switch transistor and a second pole plate connected with the first pole of the first switch transistor;

a second capacitor comprising a first pole plate connected with the first pole of the first switch transistor and a second pole plate connected with the gate of the drive transistor; and the drive transistor comprising a drain connected with the second drive signal source.

* * * * *